United States Patent [19]

Sykes

[11] Patent Number: 4,584,953

[45] Date of Patent: Apr. 29, 1986

[54] NEEDLE FOR A SEWING MACHINE

[76] Inventor: Leslie Sykes, 5 Castle Street, Edgeley, Stockport, Cheshire, England

[21] Appl. No.: 679,214

[22] Filed: Dec. 7, 1984

[30] Foreign Application Priority Data

Dec. 8, 1983 [GB] United Kingdom ..... 8332860

[51] Int. Cl.[4] ..... D05B 85/00

[52] U.S. Cl. ..... 112/222; 112/226

[58] Field of Search ..... 112/222, 226, 223, 224; 223/102, 103

[56] References Cited

U.S. PATENT DOCUMENTS

| | | | |
|---|---|---|---|
| 216,141 | 6/1979 | Bridge | 112/222 |
| 721,588 | 2/1903 | Manwaring | 112/224 |
| 724,522 | 4/1903 | Thomas | 112/224 |
| 946,789 | 1/1910 | Smith | 112/222 |
| 1,235,587 | 8/1917 | Moffatt | 112/222 |
| 2,409,445 | 10/1946 | Newman | 112/222 |
| 3,862,611 | 1/1975 | Kunomegawa | 112/222 |
| 3,986,468 | 10/1976 | Szostals et al. | 112/222 |

*Primary Examiner*—Werner H. Schroeder
*Assistant Examiner*—Andrew M. Falik
*Attorney, Agent, or Firm*—Oblon, Fisher, Spivak, McClelland & Maier

[57] ABSTRACT

A needle including a shank (11) having a portion (12) adapted to be clamped in the needle holder of a sewing machine on one of its ends and a point (13) on the other of its ends, an eye (14) passes through the shank and relieved portions forming scarfs (15) are provided on each of the two opposite sides of the needle on the side of the eye opposite the point. The needle can properly sew in each of two positions in the needle holder angularly spaced by 180°.

2 Claims, 3 Drawing Figures

NEEDLE FOR A SEWING MACHINE

BACKGROUND OF THE INVENTION

1. Field of the Invention

This invention concerns a needle for a sewing machine, particularly, though by no means exclusively, a domestic sewing machine.

2. Discussion of the Background

Conventional sewing machine needles whether for industrial or domestic use are provided with a relieved portion known as a scarf above the eye on one side only of the needle, requiring the needle to be fitted to the sewing machine in a proper axially oriented position in order to sew.

It is a matter of record that many housewives, as well as industrial operators, frequently insert their needles incorrectly and many service calls are made to domestic premises for a fault merely requiring that the engineer correct the fitting of the needle.

BRIEF DESCRIPTION OF THE INVENTION

It is an object of the present invention to provide a needle for a sewing machine which overcomes the problem aforesaid.

According to the present invention there is provided a needle for a sewing machine comprising a shank extending from a portion adapted to be clamped by the needle holder of a sewing machine, a point on the end of the shank remote from said portion, an eye through the shank spaced from said point and a relieved portion forming a scarf on each of opposite sides of the shank on the side of said eye opposite the point.

Each of the two sides of the needle may be provided with an axially extending groove running from the end portion remote from the point into the scarf on that side.

BRIEF DESCRIPTION OF THE DRAWINGS

The invention will be further apparent from the following description, with reference to the several figures of the accompanying drawings, which show, by way of example only, one form of needle adapted for use with a domestic sewing machine and embodying the invention.

Of the drawings.

and

Figure 1:
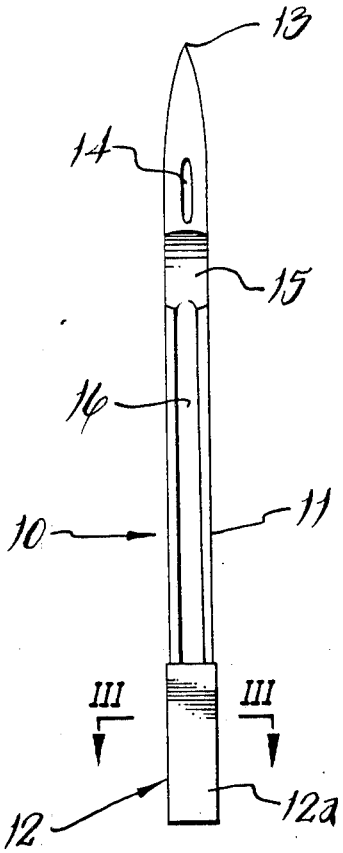
FIG. 1 shows a side elevation of the needle.
Figure 2:
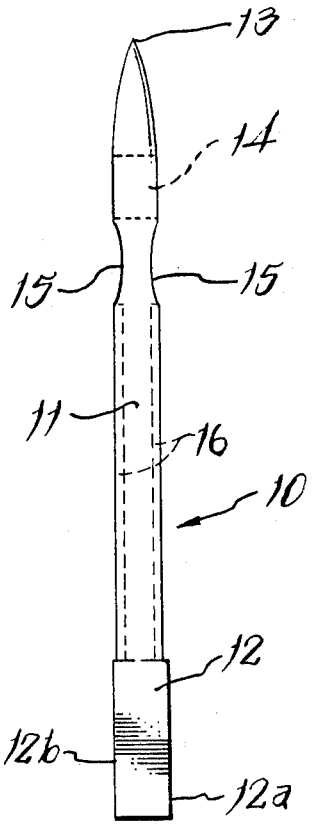
FIG. 2 shows an elevation of the needle in the direction of the arrow II on FIG. 1.
Figure 3:
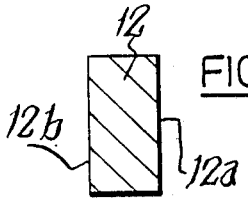

FIG. 3 shows a cross-section through the needle on the line III—III of FIG. 1 on an enlarged scale.

DESCRIPTION OF THE PREFERRED EMBODIMENTS

Referring now to the drawings it will be seen that the needle which is generally indicated at 10 comprises a cylindrical shank 11 extending from an end portion 12 adapted to be clamped by the needle holder of a domestic sewing machine, the portion 12 has flats 12*a* and 12*b* on opposite sides thereof enabling the needle to be located and clamped in the holder in either of two positions angularly spaced by 180° from one another.

The end of the shank 11 remote from the portion 12 is formed into a point 13, and an aperture forming the eye 14 of the needle extends through the shank at a position slightly spaced from the point 13. The shank has relieved portions forming scarves 15 on each of its opposite sides on the side of the eye 14 nearer to the portion 12 and also on each of its sides a groove 16 extending from the portion 12 and running into the scarf 15 on that side.

It will be appreciated that the needle can properly sew regardless of in which of each of its two positions it is mounted.

It will be appreciated that it is not intended to limit the invention to the above example only, many variations, such as might readily occur to one skilled in the art, being possible, without departing from the scope thereof.

The invention may be applied to industrial sewing machine needles, the portion 12 being modified as necessary.

Obviously, numerous modifications and variations of the present invention are possible in light of the above teachings. It is therefore to be understood that within the scope of the appended claims, the invention may be practiced otherwise than as specifically described herein.

What is claimed as new and desired to be secured by letters patent of the United States is:

1. A needle for a sewing machine comprising a shank extending from a portion adapted to be clamped by the needle holder of a sewing machine, a point on the end of the shank remote from said portion, an eye through the shank spaced from said point and a relieved portion forming a scarf on each of opposite sides of the shank on the side of said eye opposite the point such that said scarfs are substantially symmetrical wherein an axially extending groove is provided running from the end portion remote from said point into the scarf on two sides of the needle.

2. A needle according to claim 1 wherein said portion adapted to be clamped by the needle holder of a sewing machine has flats on opposite sides thereof enabling clamping in either of two positions angularly spaced by 180° from one another.

* * * * *